United States Patent [19]

Olaechea

[11] Patent Number: 4,905,456

[45] Date of Patent: Mar. 6, 1990

[54] PROCESS FOR THE AUTOMATED PLACING OF FRUIT IN PACKING CASES AND THE CORRESPONDING MACHINERY

[76] Inventor: Rosalina P. Olaechea, Plaza del Reino, 4,, Alzira (Valencia), Spain

[21] Appl. No.: 245,673

[22] Filed: Sep. 16, 1988

[30] Foreign Application Priority Data

Sep. 16, 1987 [ES] Spain ..... 8702664

[51] Int. Cl.[4] ..... B65B 5/10; B65B 35/38

[52] U.S. Cl. ..... 53/446; 53/448; 53/475; 53/537; 53/538; 53/544; 53/247; 294/65

[58] Field of Search ..... 53/149, 245, 247, 446, 53/448, 475, 534, 535, 537, 538, 544; 294/65; 414/54, 59, 63, 68, 72, 97, 733, 734, 736, 737, 902

[56] References Cited

U.S. PATENT DOCUMENTS

| | | | |
|---|---|---|---|
| 2,957,290 | 10/1960 | Andreessen | 53/544 X |
| 3,077,993 | 2/1963 | Mulvany et al. | 414/737 X |
| 3,168,204 | 2/1965 | Voullaire | 53/247 X |
| 3,453,802 | 7/1969 | Riddington | 53/247 X |
| 3,609,938 | 10/1971 | Paddock | 53/247 X |
| 3,991,885 | 11/1976 | Warren | 414/733 X |
| 4,444,423 | 4/1984 | Montferme et al. | 294/65 X |
| 4,444,424 | 4/1984 | Lebret | 294/65 X |

*Primary Examiner*—Horace M. Culver

*Attorney, Agent, or Firm*—Birch, Stewart, Kolasch & Birch

[57] ABSTRACT

The process includes an initial phase in which pieces of fruit in a line are lifted by suction and the line of fruit is then transferred to the packing case with one piece of fruit situated in the central zone of the line being displaced angularly and the remainder of the fruit either side of this central piece being displaced towards the center of the line prior to the entry of the line of fruit into the case. After entry, the pieces of fruit resume their initial position and are deposited in the case and the suction is discontinued. The machinery includes a mechanism having a plurality of vacuum operated suction pads of which the central suction pad can be moved angularly and the remainder have the means to be displaced laterally.

11 Claims, 5 Drawing Sheets

PROCESS FOR THE AUTOMATED PLACING OF FRUIT IN PACKING CASES AND THE CORRESPONDING MACHINERY

The present invention is directed to a process for the automated placing of a plurality of pieces of fruit in packing cases and a machine for carrying out the process which provides considerable advantages over existing manual procedures by almost eliminating the requirement for hand filling operations as currently practiced in filling cases with fruit.

There have in fact been a number of attempts at automating the process of fruit packing without any satisfactory results. The current procedure is still a manual operation in which a number of operatives are stationed on either side of an endless belt and along its length and on which the previously graded pieces of fruit arrive. Fruit is manually picked off the endless belt as it passes in front of the them and is manually placed in cases, arranging the pieces usually in the case in a quincunx formation.

The diverse efforts to mechanize this phase of the packing operation have failed partly due to the need to handle the fruit with considerable car particularly species such as peaches which are especially prone to the effect of bruising and to damage to the natural skin from mechanical contact but also because the conventional fruit packing cases are made in such a way that the two end walls are provided with upper flanges limiting the top open area of the case and hence limiting the access to the interior of the case for any mechanical handling means of stacking the pieces of fruit within it.

The present invention offers the means of overcoming the above mentioned problems in defining a process and the corresponding machine which enable the pieces of fruit to be packed into the packing case which can be of the conventional design, totally automatically and with a considerable saving in labor.

The process which is the object of this invention includes the arranging of a given number of pieces of fruit of similar grading in consecutive lines on an inclined plane such that each of the lines contains the maximum number of pieces of fruit to be packed into one case. The fruit in one of the lines is then raised by means of suction applied to the fruit for lifting the pieces vertically upwards on a trajectory that then proceeds on a curvilinear path followed by a vertically downwards path towards the case into which the fruit is to be placed. Before the actual entry into the mouth of the case a piece of fruit in the central zone of the line being packed is displaced angularly in such a way that the pieces forming the two lateral zones can be displaced towards the center of the line such that the line thus formed is of a length less than the open dimension of the packing case defined by the flanges at the top of the end walls of the case. Once the line of fruit has entered the case the pieces of fruit are again displaced back to their initial positions and in their original line before being deposited in the case. The packing case is then moved sideways and the cycle is repeated to pack a new line of fruit in the case. Upon completion of one layer the box is then displaced vertically in preparation for the next layer to be deposited.

The machine which corresponds to the above process and which is object of the present invention includes of a support for the fruit packing case in the form of a platform which can displace the case in a controlled manner in three orthogonal axes and is provided with a cylinder system enabling the case to be withdrawn from the displacing station once it has been filled. This supporting platform is located in front of an inclined belt on which are placed a plurality of correctly aligned pieces of fruit to be packed, all being of the same grading.

A number of bell-shaped suction pads, arranged in a straight line and and all connected through to a suitable evacuation pump system so that the fruit can be raised by suction are provided so that the lines of fruit can be transferred from the inclined belt into the packing case which also is on an inclined plane. Each of these suction pads can hold one piece of fruit but due to the end wall flanges of the cases the total length of the line of fruit must be inferior to the useful width of the bottom of the case on entering entering the case, thus giving rise to two objections: the loss of useful packing space and the consequent loose storage of the fruit which will allow movement within the case and hence damage to the contents.

The present invention overcomes these objections by incorporating a device in the mechanism which allows one central suction pad element to be diverted from the line of fruit to either side of this element, the two lines either side of this central element with their respective suction pads being on two mobile supports which can then move in towards the center once the central element has been withdrawn. In this manner the resulting line of fruit held by the suction mechanism for transferring it from the belt where it is temporarily stored into the packing case is shortened to the extent that it no longer fouls the flanges on the side walls of the case. Once within the case the suction pad elements forming the line take up their original positions including the central pad itself, thus restoring the full length of that line of fruit.

Following the placement of each line of fruit in the case the support holding the case is moved in a transverse direction a distance equivalent to the width of one diametere of the fruit so that the following line is in a position juxtaposed to the previous line of fruit. The pieces of fruit being more or less spherical, the neighboring lines are packed in quincunx, one line having the maximum number of pieces to fit the case, the following line of fruit having one less piece.

Subsequently, once one layer of fruit has been completed the case support descends a distance equivalent to the diameter of one piece of fruit.

These various displacements of the case are such that the articulated arm component which holds the suction devices undergoes the same movement on each occasion and hence can position the pieces each time in the same place with respect to fixed coordinates, this being in view of the fact that it is much easier to program and to control the movement of the case according to the type of fruit to be packed and hence it is the case which is the displaced element in the system.

To this effect the structure supporting the case comprises for purposes of controlling its height, pairs of struts articulated at their mid position which are attached to a fixed and a mobile base plate articulated at one extremity and sliding at the other such that by applying a motor force to the central articulating point of the bars the upper mobile base plate can be displaced parallel to the lower fixed plate and in a controlled number.

The mobile baseplate is provided with transverse guides to which are fitted pairs of sliding bearings allowing a controlled transverse movement of the case actioned by a pneumatic piston or a screw assembly actuated by an electric motor so as to effect the juxtapostioning in placing the various lines of fruit within the case.

The case itself lies on rollers which allow it to move in the direction of the alignment of the fruit, these rollers having one extremity articulated and connected to the final mobile baseplate and the other connected to a component actuated by a cylinder system enabling the case to be raised to a horizontal position so that while the filling process takes place with the case in its inclined position another cylinder system located transverse to the case is able to push the case from its filling position onto a conveyor belt or inclined rollers which then convey it to a work station for the fitting of the cover over its open top.

For a better understanding of the general characteristics contributing to this process for the automated filling of fruit cases and the machine corresponding to this process, drawings are attached to this specification in which there is illustrated one embodiment of a practical application of the invention in accordance with the claims, this embodiment being purely informative and not to be interpreted restrictively but in the widest and general sense.

In the drawings:

FIG. 1 shows a lateral view of the machine for the automatic placing of fruit in packing cases;

FIG. 2 schematically shows the principal moves made by the packing case in the course of the filling operation of the present invention;

The various component reference numbers shown on the drawings correspond to like parts described below.

DETAILED DESCRIPTION OF PREFERRED EMBODIMENTS

Figure 1:
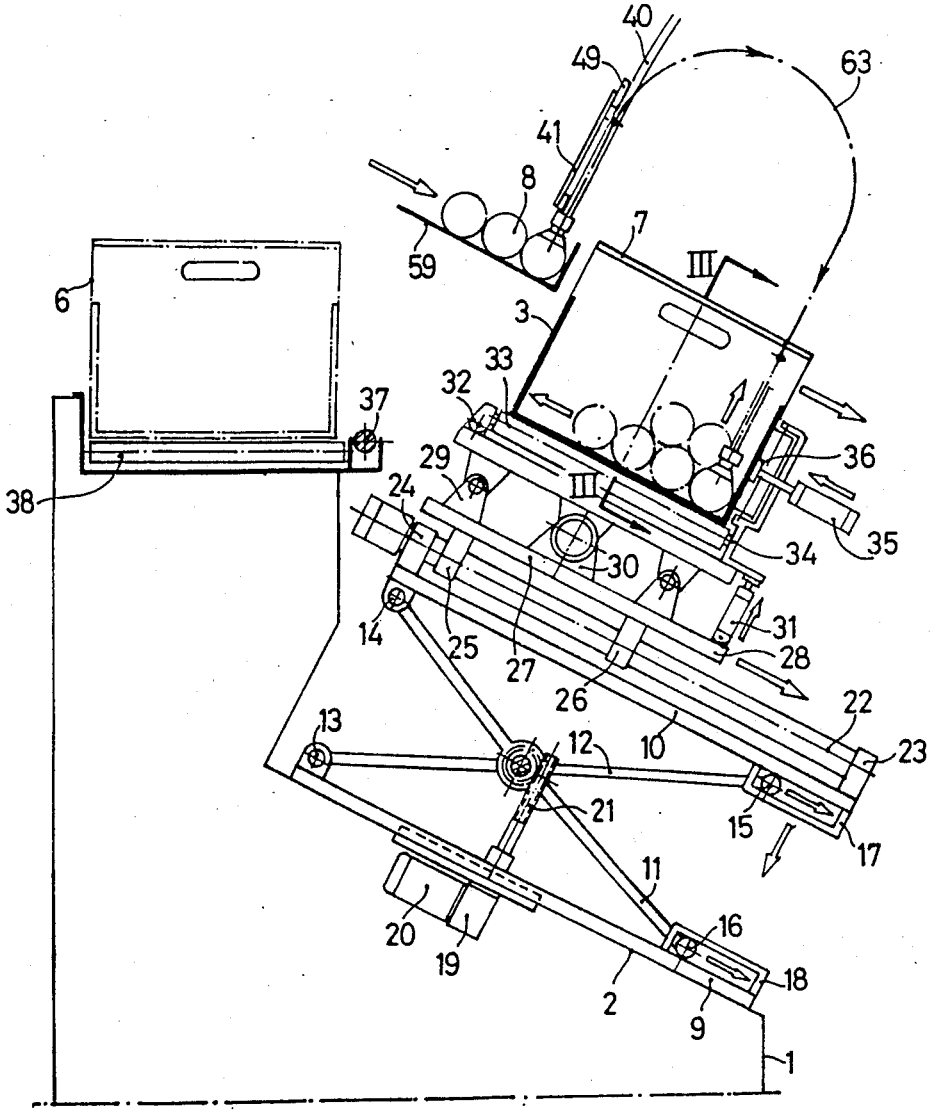

The machinery for the automatic packing of fruit in cases includes a bench 1 having at its lower end an inclined surface 2 which carries a fixed baseplate 9 of the mechanism which governs the height of a case 3. A mobile base 10 is maintained parallel to the baseplate 9 by a pair of struts 11 and 12 which are attached at one extremity only 13 and 14 to both the fixed base plate 9 and a mobile base plate 9 and 10 respectively while the other extremities 15 and 16 of the pair of struts 11, 12 are allowed to run in slots 17 and 18. These struts 11 and 12 are articulated one to the other at their mid points on on a pin which is fitted with a toothed wheel engaging with a screwthread 21 actuated by a motor 20 and reduction gear 19 which remain in train during displacement of the upper mobile baseplate 10. This mechanism of articulated bars could be placed by any other system which would allow the height of the mobile baseplate 10 to be varied with respect to the fixed base plate 9 while remaining parallel thereto.

The upper mobile base 10 has attached to its supports 23 and 24 holding guides 22 on which can slide supports 25 and 26 of a platform 27, the position of which determines the internal relative location of each line of fruit within the packing case. This platform 27 moves in the direction shown by the arrow 4 (FIG. 2) through a distance equivalent to the diameter of one piece of fruit such that a succeeding line of fruit is positioned adjacent to the preceeding line of fruit.

Figure 2:
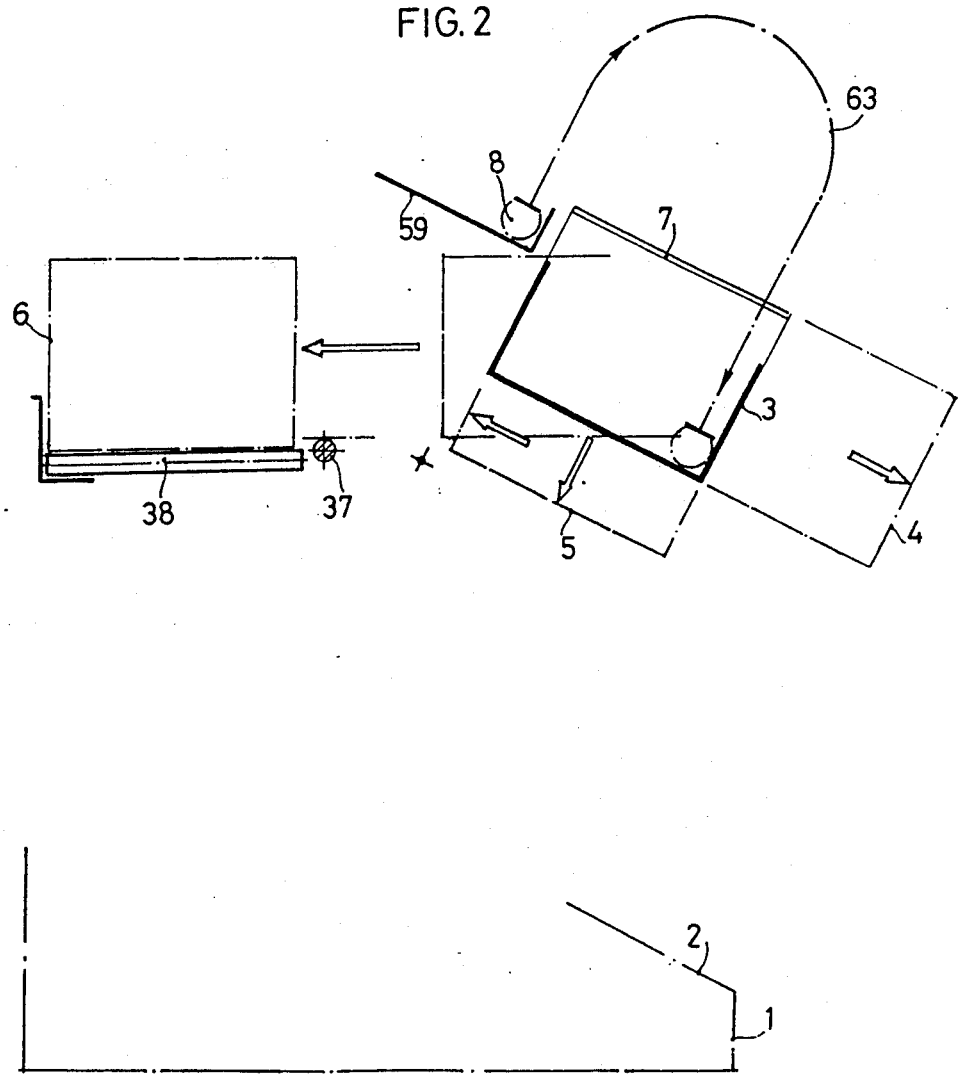
Figure 3:
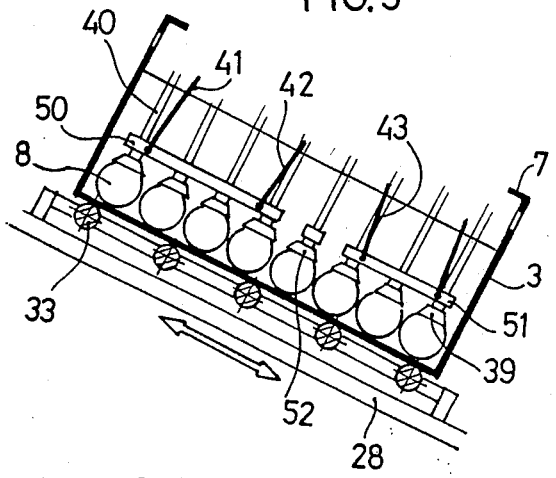
FIG. 3 is a sectional view of a packing case during the phase of placing one line of a plurality of pieces of fruit in the case.
Figure 4:
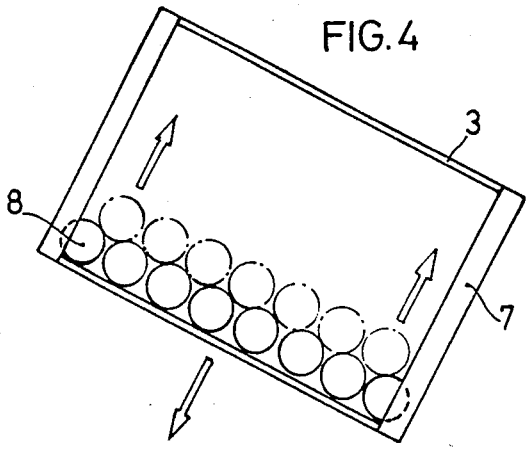
FIG. 4 shows a plan view of the case.
Figure 5:
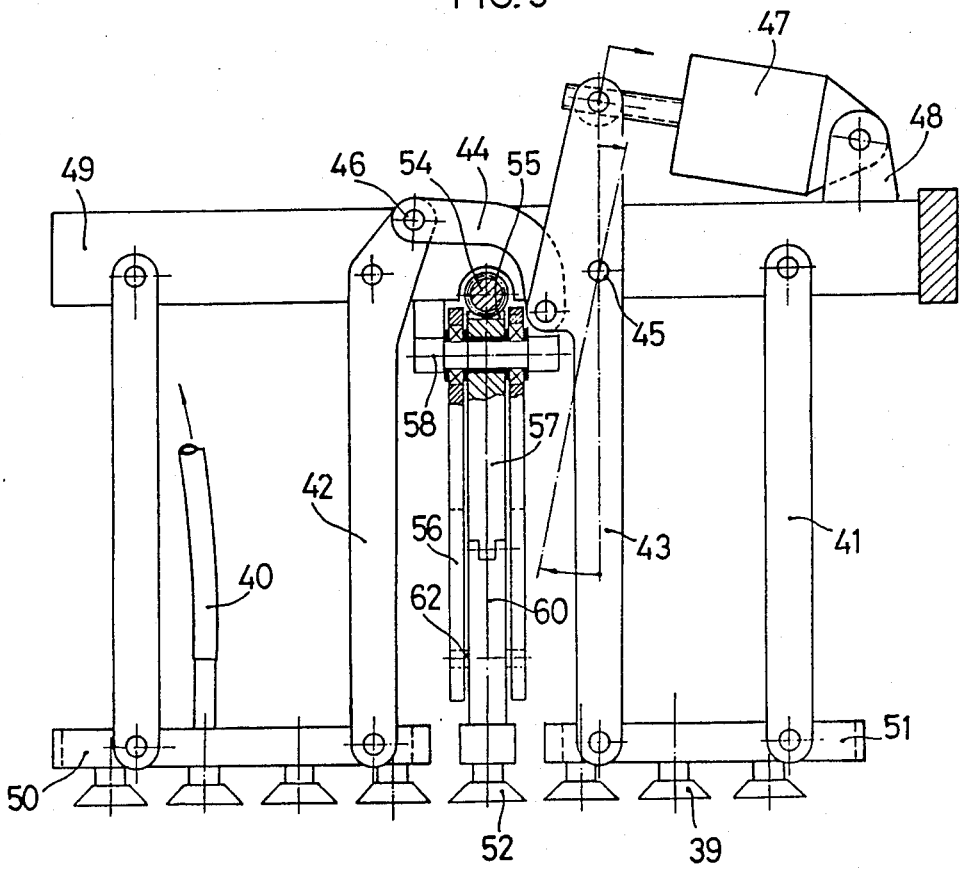
FIG. 5 is a front partial sectional view of the mechanism holding the suction devices.
Figure 6:
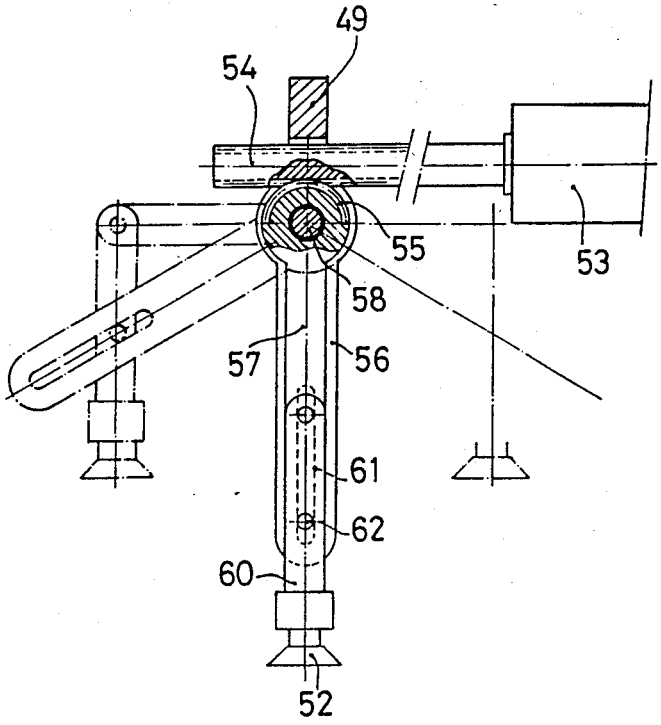
FIG. 6 shows details of the mechanical linkage system which permits one of the suction elements to be displaced from the line of such elements.

The platform 27 has attached thereto support components 29 and 30 to carry a base 28 which at one of its extremities is situated a pivotable anchor member for securing ends of the rollers 33 on which the packing case rests directly and freely. The other end of the rollers 33 are housed, so that the rollers 33 can rotate in a famework 34 resting on tthe base 28. The rollers 33 are able to hinge upwards about the pivotable anchor when raised by means of pneumatic cylinder 31 to a position in which the rollers 33 are horizontal as seen in FIG. 2. This occurs when the case has been fully packed and is in its lowest position 5 having received the final layer of fruit. A pneumatic cylinder 35 having a pusher plate 36 mounted on the framework 34 pushes the packing case to its position 6, the case rolling over a transverse roller 37 perpendicular to the rollers 33 and being deposited on a roller system 38 which conveys the case 3 a close and sealing station.

The mechanism for transfering the pieces of fruit 8 from a belt conveyor 59 to the interior of the case 3 consists of an articulated mechanical arm which goes through a reverse procedure of extraction, lifting and descent, the case itself being the element that varies its movement so as to define the position in which the various lines and layers of fruit are placed within the case. This articulated arm carries a transverse beam 49 from which are suspended a number of connecting members 41 which form together with beams 50 and 51 two parallelograms. Two connecting members 42 and 43 are widened to take a connecting component 44 at the articulating points 45 and 46 such that they are kinematically joined to move in an opposing direction. The connecting member 43 also has a further upper extension to provide for the actuation of both the parallelograms by means of a pneumatic cylinder 47 which is mounted on a beam 49 through lugs 48.

Between these two parallelograms there is an articulated component which can undergo movement perpendicular to the plane of the parallelograms.

This latter articulated component comprises a pivot pin 58 on which can pivot freely two elongated plates 56 having a longitudinal slot 61 in which can slide a boss 62 protruding laterally from the lower half 60 of an articulated component of which the upper half 57 itself pivots on the pin 58 and has on its upper surface a toothed area engaging with a mating gearcut spindle 54 driven by a motor 53 so that the component 57 can be raised on either side of the plane represented by the mechanism for holding the fruit in suspension.

On each of the beams 50 and 51 as well as on the articulated intermediate component 52, there are one or several mouthpieces 39 in the shape of spherical pads suited to adapt to the shape of the fruit, these being connected through to a vacuum system enabling the fruit to be raised by suction.

The empty case having arrived on the rollers 33 the initial operation is that each of the suction pads take up one piece of fruit from the converyor belt 59 on which they have been perfectly alligned, these pieces once withdrawn being replaced at once by the next row from above on the conveyor. The suction lifting device then traces out the trajectory shown in FIG. 1 as 63 and which consists of a linear upward movement, followed by a half circle and then a further linear descent. To ensure the optimum packing arrangement the total length of the line of fruit transfered from the conveyor 59 to the interior of the packing case should be equal to the width of the bottom of the case. Due to the upper flanged edges of the case 7 the width of the top opening is in fact less than the width of the bottom of the case so as to reduce the total width of the line of fruit while being transfered over the trajectory 63. The toothed spindle 54 causes the articulated arm 57 to rise allowing the pneumatic cylinder 47 to actuate the connecting plate 43 and hence the two parallelograms formed by 49, 50 and 51 such that they come together with the two extremities face to face, thereby taking up the space made available by the removal of the element 52 caused by the articulation of the arm 57 and thus resulting in the total length of the line of suction pads being sufficiently reduced to allow the line to pass easily between the edge flanges 7 at the top of the packing case. Once the line of fruit is within the case the above procedure is reversed so that the full line attains a width equal to that of the bottom of the packing case. Since the end connecting members 41 can be situated within the full width of the overall lifting device, they have no need to come into contact with the flanges 7.

If in the following line of fruit the pieces are required to be placed in quincunx as in the embodiment illustrated only n-1 pieces are picked up, n being the maximum number required to span the full width of the case, the next line being n pieces and so on until the layer has been completed. The control of the number of pieces to be picked up at each operation of the articulated arm is carried out by means of the vacuum tubing regulation, 40 preferably the tube associated with the suction pad 52 of the articulated arm.

Anything not affecting, altering, changing, or modifying the essentiality of the above described process is a variable for purposes of the present invention.

I claim:

1. A process for the automated placing of fruit in packing cases comprising the steps of:

(a) applying suction to a plurality of pieces of fruit arranged in a line equivalent to a quantity required to fill a corresponding line in a case that is to be filled with fruit and in the identical relative positions with respect to each other;

(b) carrying said line of pieces of fruit first in an ascending vertical trajectory followed by a curvilinear path and a further vertical descending path towards the packing case (c) angularly displacing one piece of fruit situated in a central zone of said line of pieces of fruit;

(d) linearly displacing the other pieces of fruit on either side of the angularly displaced piece of fruit toward the central zone such that the length of the line of fruit is reduced by an amount that allows the fruit to enter the packing case opening;

(e) depositing the fruit within the case in their initial linear arrangement; and (f) ceasing the suction operation once the fruit has been placed in the case.

2. A process for the automated placing of fruit in packing cases according to claim 1, wherein after each step of placing a line of fruit in the packing case, the case is moved laterally so that a subsequent line of fruit is placed adjacent the preceeding line until a layer is complete followed by displacing the case in height through a distance equal to the next layer to be placed above the layer of fruit already in the case.

3. A process for the automated placing of fruit in packing cases according to claim 2, wherein the number of pieces to which suction is applied can vary as a function of the arrangement of the pieces of fruit in the packing case by not applying suction to pieces situated at the ends of the line of fruit.

4. A process for the automated placing of fruit in packing cases according to claim 3, wherein once a packing case has been filled it is withdrawn from the filling zone and it is replaced by another empty case.

5. A process for the automated placing of fruit in packing cases according to claim 1, and further including moving the case in any one of three orthoginal axes to pack said case as described in steps (a) through (f) row by row and layer by layer.

6. An apparatus for automatically placing fruit in packing cases comprising:

means for individually applying a gripping force to each of a plurality of pieces of fruit, said plurality of pieces of fruit being arranged linearly and in predetermined quantities;

means for carrying said pieces of fruit first in an ascending vertical trajectory, then in a curvilinear path, and then in a vertical descending trajectory towards said packing case;

means for angularly displacing one piece of fruit in said linear arrangement with respect to the remaining pieces of fruit;

means for linearly displacing the remaining pieces of fruit and filling a gap left by the angularly displaced piece of fruit, wherein the length of said linearly arranged pieces of fruit is reduced by an amount equal to that of said angularly displaced piece of fruit;

means for depositing said fruit within said packing case in the initial linear arrangement; and means for releasing said individually applied gripping force on each of said plurality of pieces of fruit.

7. An apparatus for automatically placing fruit in packing cases according to claim 9, wherein said means for individually applying a gripping force includes a plurality of suction pads connected to a transverse beam suspended directly from an articulated arm, and further including two shorter beams located below the transverse suspended beam and joined thereto by at least two pairs of connecting members forming two articulated parallelograms having lower members for supporting the suction pads, and an articulated member positioned between the two parallelograms from which an independent suction pad is rotatably supported with respect to the axis of the transverse suspended beam and being displaceable on a plane perpendicular to the plane of the parallelograms.

8. An apparatus for automatically placing fruit in packing cases according to claim 6, wherein the connecting members joining the horizontal beams of the lower members for holding the suction pads are kinematically connected both mutually and to an actuator device.

9. An apparatus for automatically placing fruit in packing cases according to claim 8, wherein said actuator device is a pneumatic cylinder.

10. An apparatus for automatically placing fruit in packing cases according to claim 6, wherein the articulated member between the two parallelograms from which an independent suction pad is supported is a vertical member having two sections, an upper section being freely pivotable on an axis parallel to the horizontal beams and having at its upper end a gear tooth zone engaging with a corresponding toothed spindle, this said vertical member being flanked by two longitudinal strips pivoting on the same axis and having therein longitudinal slots in which slide bosses protrude from either side of the vertical member.

11. An apparatus for automatically placing fruit in packing cases according to claim 6, and further including means for supporting said packing case on an incline during filling thereof and for moving said packing case in any one of three orthogonal axes to enable sequential placing of fruit in said packing case to form rows and layers of fruit.

* * * * *